United States Patent [19]

Lissoni

[11] 3,972,769

[45] Aug. 3, 1976

[54] TOOL FOR DISTRIBUTING ADHESIVE TAPE

[75] Inventor: Adelio Lissoni, Vedano Olona (Varese), Italy

[73] Assignee: S.I.A.T. - Societa' Internazionale Applicazioni Tecniche S.p.A., Milan, Italy

[22] Filed: May 3, 1974

[21] Appl. No.: 466,854

[30] Foreign Application Priority Data

May 3, 1973 Italy ..... 21355/73

[52] U.S. Cl. ..... 156/577; 156/579

[51] Int. Cl.[2] ..... B32B 31/00

[58] Field of Search ..... 156/577, 523, 527, 576, 156/574, 579

[56] References Cited

UNITED STATES PATENTS

| | | | |
|---|---|---|---|
| 2,728,477 | 12/1955 | Vogt | 156/527 |
| 2,755,953 | 7/1956 | Vogt | 156/527 |
| 3,156,603 | 11/1964 | Robinson | 156/577 |
| 3,310,452 | 3/1967 | Hartley et al. | 156/577 |
| 3,565,727 | 2/1971 | Guest | 156/527 |
| 3,880,701 | 4/1975 | Moree | 156/526 |

*Primary Examiner*—Douglas J. Drummond
*Assistant Examiner*—M. G. Wityshyn
*Attorney, Agent, or Firm*—Young & Thompson

[57] ABSTRACT

Hand tool for distributing and applying adhesive tape fed from a tape roll, comprising a handgrip, at least a first and a second support plate or bracket parallel to and spaced from each other and fixed to the handgrip, means for applying and means for retaining the free end of the tape, mounted on said plates or brackets, the tape roll being at least in part freely housed between said first and said second plate and being stopped from coming out by the retaining action of said retaining means, which lock the free end of the tape.

3 Claims, 1 Drawing Figure

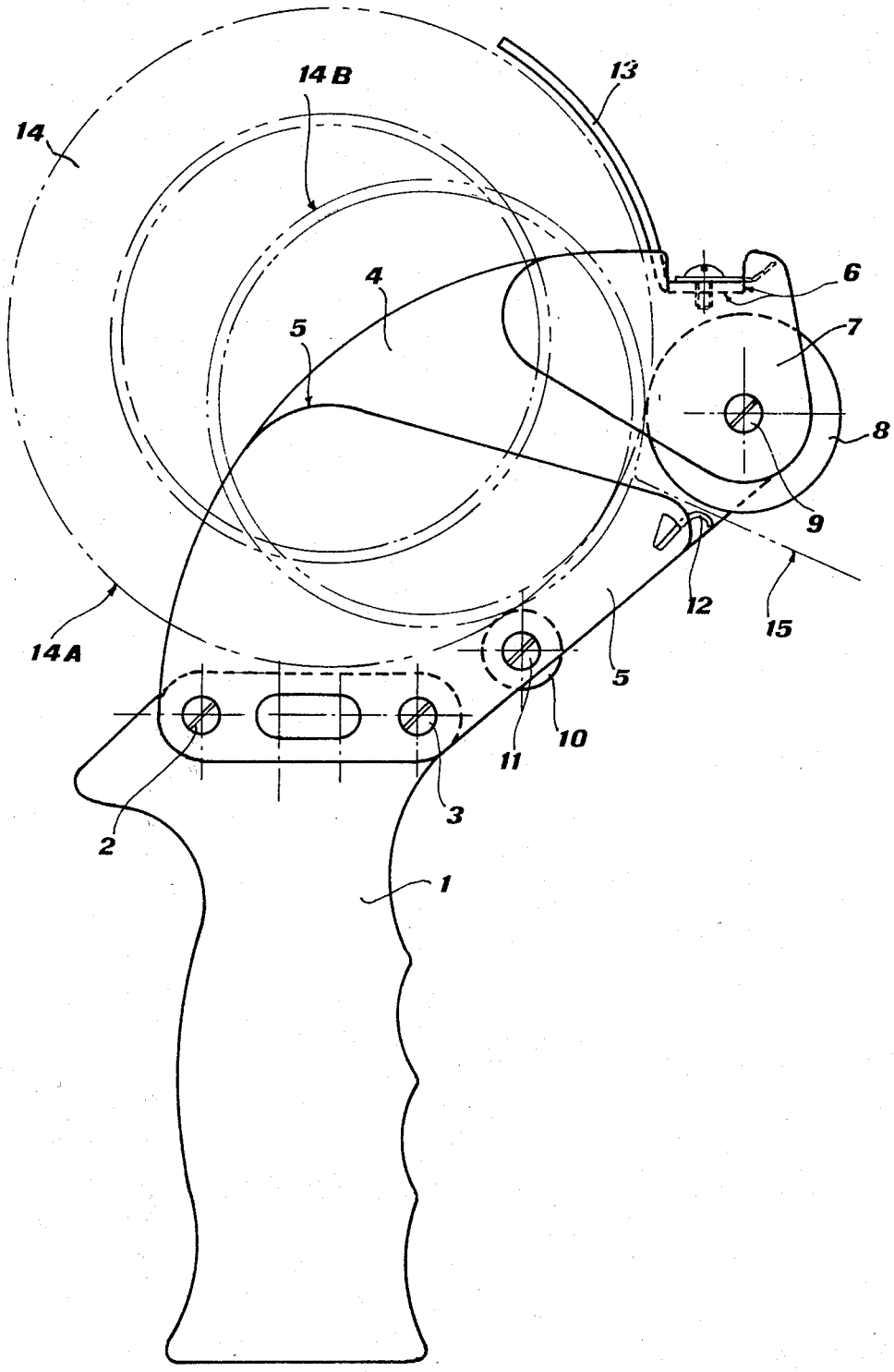
14B
13
14
4
6
5
7
8
9
12
15
14A
5
10
11
3
2
1

TOOL FOR DISTRIBUTING ADHESIVE TAPE

BACKGROUND OF THE INVENTION

1. Field of the Invention

The object of the present invention is a tool for distributing and applying adhesive tape, and more specifically self-adhesive tape for packing, said tool having an extremely simplified structure, both from the point of view of use and from the construction point of view, and resulting in a tool which is considerably lightened, more handy and of lower cost.

2. Description of the Prior Art

Tools of this type are generally provided with a handgrip with which is associated at least a support bracket or plate, on the latter being mounted, on the one hand means for supporting a roll of adhesive tape to be fed, said means being formed so as to allow the free rotation of the roll, and on the other hand means for applying and means for retaining the free end of the tape.

Said applying means generally consist of a roller, mounted freely rotatable on its axis and against which bears the non-adhesive surface of the tape when applying the tape itself, while said retaining means may consist of any means adapted to prevent the tape from being accidentally called back towards the feed roll, for example of a small knurled roller contacting the adhesive face of the tape and adapted to rotate only in the feeding direction, or alternatively, of an oscillating tongue, as described in the Italian Utility Model No. 151,825, in the name of the same Assignee.

This Italian Model No. 181,825 has already proposed an improved tool structure for the distribution of adhesive tape, particularly designed to facilitate and speed up the mounting and replacement of a new tape roll on the tool itself. Contrary to the known art — according to which, in order to replace a finished roll by a new tape roll, one has to carry out relatively complicated operations, such as the unscrewing and drawing out of a pin, mounted between two plates and provided for supporting the roll — in the tool proposed in the Model No. 181,825, said support pin is mounted cantilevered and the new tape roll may be mounted by mere axial insertion, by forcing lightly on its seat.

SUMMARY OF THE INVENTION

The tool structure according to the present invention, is even more simplified compared to said Model No. 181,825, due to the fact that all support means for the tape roll, in the form of a fixed pin, are entirely eliminated; said tool structure actually comprises a handgrip, a first plate or bracket fixed to the handgrip and carrying said applying means or roller and said retaining means, and a second plate or bracket, opposed to the first and carrying, in cooperation therewith, said retaining means, and between said first and said second plate at least a partial housing for the tape roll, the latter being simply freely supported between said two side plates of the tool and being stopped from coming out by the retaining action of said retaining means which lock the free end of the tape.

According to a preferred embodiment, close to said tape applying and retaining means is provided a second roller freely bearing the tape roll.

As can be easily understood, this tool structure is extremely simplified and is considerably different from all the known structures, including those described in the above cited Italian Model No. 151,825, as well as in the Model No. 154,740, in the name of the same Assignee.

BRIEF DESCRIPTION OF THE DRAWINGS

Several characteristics and advantages of the tool structure according to the invention will be evident from the following description, given with reference to the accompanying drawing, which shows a schematic side view thereof.

DESCRIPTION OF THE PREFERRED EMBODIMENT

As shown, the tool according to the invention comprises a handgrip 1, at the top of which are fixed — by means of through screws 2 and 3, and associated nuts — a first plate 4 and a second plate 5; the two plates 4 and 5 thus are arranged in two parallel spaced planes.

The plate 4 is provided, at its end opposite to the handgrip 1, with a square bent portion 6 forming a crosspiece, and with an ear-shaped portion 7, also square bent in respect of the portion 6 and lying in the same plane as the plate 5, the group of elements 4, 6 and 7 having, in cross section, a substantially U-shaped profile.

Between the plate 4 and the ear 7 is mounted the roller 8, freely rotating on the pivot formed by the bolt or screw 9.

Between the plate 4 and the plate 5 is further mounted a second roller 10, in turn freely rotating on the pivot formed by the bolt or screw 11. Between the plates 4 and 5 is finally mounted the oscillating tongue 12, forming the above mentioned tape retaining means.

As already known from the above mentioned Italian Models No. 151,825 and No. 154,740, a free passage is preferably provided between the plates 5 and 7, in registry with the free space between the roller 8 and the tongue 12: this construction in fact allows a very simple lateral insertion of the starting end of the tape when having to mount a new tape roll on the tool. The same Italian Model No. 151,285 further describes the operation of the tongue 12: the latter may in fact oscillate between the position shown in the drawing (in which the tape freely unwinds from the roll, passing over the roller 8) and a position in which the tongue 12 is shifted backward and bears its free edge against the periphery of the roller 8, locking the end of the tape 15 (the tongue 12 is shifted to this locking position by the action of the actual tape 15 which tends to return towards the inside of the tool thanks to the mere weight of the tape roll).

To the square bent portion 6 of plate 4 is further secured the protection plate 13, projecting upwards and slightly curved, said protection plate 13 substantially delimiting and protecting the space housing the tape roll 14.

The operation of the tool according to the invention is extremely simple:

when having to mount a new roll of tape on the tool, one has to unwind a short length of tape 15, forcing it to pass between the ear 7 and the plate 5, until it is disposed between the roller 8 and the tongue 12. Then, one pulls the tape, introducing at the same time the roll 14 between the plate 4 on one side and the plate 5 and ear 7 on the other side, until its periphery is brought to bear against the periphery of the roller 8 and of the second roller 10. In this position — which, for a new tape roll, is shown by the dash-and-dot line 14A, while, for an almost entirely unwound roll, is shown by the dash-and-dot line 14B — the roll is always laterally retained by the actual plates 4 and respectively 5, 7, and is moreover radially retained and stopped from extraction movements, by the adhesion of the free end of the tape 15 itself to the tongue 12, in a known manner.

It was surprisingly found that the retaining action produced by the tongue 12, together with the fact that the tape 15 unwinds from the roll 14 only with a certain effort due to the adhesion of the tape itself, is more than sufficient to guarantee that the roll is correctly held on the tool.

The great advantage of the above described structure, compared to the known structures, is self-evident, not only from the construction and economic point of view — thanks to the reduced number of component parts, mounted with a few screws or bolts — but also from the point of view of use, thanks to the lightness, handiness and rapidity in replacing the tape roll (the fully unwound roll dropping automatically from the tool, as it is no longer retained by the tongue 12), and to the better balancing during use (determined by the fact that the region on which the tape roll presses is considerably closer to the handgrip).

It is anyhow understood that the invention is not limited to the embodiment described, but that different embodiments may be provided, without thereby departing from the scope of the present invention.

I claim:

1. Hand tool for dispensing and applying adhesive tape fed from a tape roll, comprising a handgrip; at least a first and a second support plate parallel to and spaced from each other and fixed to the handgrip; a first and a second roller, means mounting said rollers freely rotatably about their respective axes with said axes being in parallel, spaced relation on and between said support plates, said rollers comprising the sole means for supporting the tape roll with the periphery of the tape roll bearing against said rollers, the first of said rollers forming also means for applying the tape; means for retaining the free end of the tape, in the form of a tongue that oscillates against the periphery of said first roller, the tape passing between said spaced rollers and between said first roller and the tongue, with its adhesive surface turned towards the tongue, the backward movement of the tape end dragging the tongue, by adhesion, against the periphery of the first roller thereby to retain the tape roll between said plates.

2. A hand tool as claimed in claim 1, said first support plate at the end remote from the handgrip being bent to substantially U-shaped profile with the branches of said profile supporting between them a pivot for said first roller, said pivot comprising said mounting means for said first roller.

3. A hand tool as claimed in claim 2, one said branch of said first plate being coplanar with said second plate and spaced from said second plate by a gap, said gap being in registry with the space between said first roller and said tongue.

* * * * *